US010952573B2

(12) United States Patent
Harrington et al.

(10) Patent No.: US 10,952,573 B2
(45) Date of Patent: Mar. 23, 2021

(54) CLEANING DEVICES WITH SELECTIVELY FLEXIBLE OR RIGID HANDLES

(71) Applicant: Unger Marketing International, LLC, Bridgeport, CT (US)

(72) Inventors: William Harrington, Charlestown, RI (US); John A. Triunfo, Fairfield, CT (US); Robert F. Smith, Waterbury, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 6 days.

(21) Appl. No.: 16/382,800

(22) Filed: Apr. 12, 2019

(65) Prior Publication Data

US 2019/0239704 A1 Aug. 8, 2019

Related U.S. Application Data

(63) Continuation of application No. 14/791,531, filed on Jul. 6, 2015, now Pat. No. 10,258,205, which is a continuation of application No. 29/496,191, filed on Jul. 10, 2014, now Pat. No. Des. 761,568, and a (Continued)

(51) Int. Cl.

| | |
|---|---|
| ***A46B 5/02*** | (2006.01) |
| ***A46B 9/02*** | (2006.01) |
| ***A47K 11/10*** | (2006.01) |
| ***A46B 5/00*** | (2006.01) |

(52) U.S. Cl.

CPC ..... *A47K 11/10* (2013.01); *A46B 5/0037* (2013.01); *A46B 5/0062* (2013.01); *A46B 5/0066* (2013.01); *A46B 5/0095* (2013.01); *A46B 5/02* (2013.01); *A46B 9/02* (2013.01); *A46B 2200/304* (2013.01)

(58) Field of Classification Search

CPC ..... A47K 11/10; A46B 5/0037; A46B 5/0062; A46B 5/0066; A46B 5/0095

See application file for complete search history.

(56) References Cited

U.S. PATENT DOCUMENTS

| | | | |
|---|---|---|---|
| 759,490 | A | 5/1904 | Yates |
| 4,328,604 | A | 5/1982 | Adams |
| 5,054,154 | A | 10/1991 | Schiffer |

(Continued)

FOREIGN PATENT DOCUMENTS

| | | | |
|---|---|---|---|
| DE | 1986144 | U | 5/1968 |
| DE | 1995617 | U | 10/1968 |

(Continued)

OTHER PUBLICATIONS

Extended European Search Report for Europan Application No. 15176124.4; Date of Completion: Nov. 12, 2015; dated Nov. 18, 2015; 8 Pages.

*Primary Examiner* — Randall E Chin

(74) *Attorney, Agent, or Firm* — Cantor Colburn LLP

(57) ABSTRACT

A cleaning device is provided that has a handle configured to provide flexion in a first orientation but to provide rigidity in a second orientation. In this manner, the user can use the handle in the first orientation to allow the cleaning device to flex into hard to reach places and can use the same handle in the second orientation to apply differing levels of cleaning force.

20 Claims, 12 Drawing Sheets

Related U.S. Application Data continuation of application No. 29/511,377, filed on Dec. 10, 2014, now Pat. No. Des. 772,580.

(60) Provisional application No. 62/022,852, filed on Jul. 10, 2014.

(56) References Cited

U.S. PATENT DOCUMENTS

| | | | | |
|---|---|---|---|---|
| 5,158,532 | A | 10/1992 | Peng et al. | |
| 6,132,126 | A | 10/2000 | Sheffler et al. | |
| 6,154,913 | A | 12/2000 | Burton | |
| 6,237,182 | B1 | 5/2001 | Cassar | |
| 6,530,707 | B1 | 3/2003 | Byrne et al. | |
| 6,546,588 | B1 | 4/2003 | Black | |
| 7,086,116 | B2 * | 8/2006 | Broecker ..... | A46B 5/0062 15/144.1 |
| 7,213,292 | B1 | 5/2007 | Tucker | |
| 7,344,327 | B2 | 3/2008 | Gueret | |
| 8,123,712 | B2 | 2/2012 | Julius | |
| 2001/0047556 | A1 | 12/2001 | Weihrauch | |
| 2004/0143923 | A1 | 7/2004 | Bensussan et al. | |
| 2006/0070198 | A1 | 4/2006 | Deroma | |
| 2012/0183344 | A1 | 7/2012 | Habinger | |
| 2014/0099154 | A1 | 4/2014 | O'Neill | |

FOREIGN PATENT DOCUMENTS

| | | | |
|---|---|---|---|
| DE | 4435888 | A1 | 4/1996 |
| DE | 202013005066 | U1 | 8/2013 |
| WO | WO 93/15627 | * | 8/1993 |

* cited by examiner

CLEANING DEVICES WITH SELECTIVELY FLEXIBLE OR RIGID HANDLES

CROSS REFERENCE TO RELATED APPLICATIONS

The present application is a continuation application of U.S. patent application Ser. No. 14/791,531, filed Jul. 6, 2015, and since issued as U.S. Pat. No. 10,258,205, which claims priority to U.S. Provisional Application Ser. No. 62/022,852 filed on Jul. 10, 2014, and which is a continuation application of U.S. Design Application No. 29/496,191, filed on Jul. 10, 2014, and since issued as U.S. Pat. No. D761,568, and U.S. Design Application No. 29/511,377, filed on Dec. 10, 2014, and since issued as U.S. Pat. No. D772,580, the contents of all of which are incorporated by reference herein in their entirety.

BACKGROUND

1. Field of the Disclosure

The present disclosure is related to cleaning devices. More particularly, the present disclosure is related to cleaning devices with handles that are selectively flexible or rigid based on their orientation.

2. Description of Related Art

Cleaning devices that have handles are known. These cleaning devices can include, but are not limited to, dusting devices, wiping devices, brushing devices, mopping devices, and others.

In some cleaning applications, it is desired for the handle to resiliently flex or bend (hereinafter "flex") to allow cleaning in hard to reach places such as the trap of a toilet bowl. Additionally, it is often desired to apply different levels of pressure to the surface being cleaned. For example, the cleaning of lightly soiled areas may require a first level of cleaning pressure, while the cleaning of more highly soiled areas may require a second, higher level of cleaning pressure. The ability to apply different levels of pressure to the surface being cleaned requires the handle to be rigid or inflexible.

Unfortunately, it has been determined by the present disclosure that prior art cleaning devices lack the ability to be both flexible and inflexible as needed.

Accordingly, it has been determined by the present disclosure that there is a need for cleaning devices that overcome, alleviate, and/or mitigate one or more of the aforementioned and other deleterious effects of the prior art.

SUMMARY

A cleaning device is provided that has a handle configured to provide flexion in a first orientation but to provide rigidity in a second orientation. In this manner, the user can use the handle in the first orientation to allow the cleaning device to flex into hard to reach places and can use the same handle in the second orientation to apply differing levels of cleaning force.

In some embodiments, the cleaning device includes a cleaning head and a handle having an upper region joined to a lower region by a structural rib. The is at least partially encased in an elastomeric member so that the structural rib and the elastomeric member define a deflection zone that allows resilient flexion when forces are applied along a first axis but resists flexion when forces are applied along a second axis.

In one or more embodiment alone or in combination with the aforementioned or aft mentioned embodiments, the first and second axes are perpendicular to one another.

In one or more embodiment alone or in combination with the aforementioned or aft mentioned embodiments, the structural rib has a thickness that runs along the first axis and a width that runs along the second axis, the width being larger than the thickness.

In one or more embodiment alone or in combination with the aforementioned or aft mentioned embodiments, the elastomeric member comprises a different material and/or a different attribute on one side of the structural rib as compared to an opposite side of the structural rib so that the deflection zone has one level of flexibility when bending in one direction and a different level of flexibility when bending in an opposite direction.

In one or more embodiment alone or in combination with the aforementioned or aft mentioned embodiments, the elastomeric member completely encases the structural rib.

In one or more embodiment alone or in combination with the aforementioned or aft mentioned embodiments, the elastomeric member comprises a recess on opposing sides of the structural rib.

In one or more embodiment alone or in combination with the aforementioned or aft mentioned embodiments, the cleaning head has a first cleaning area associated with the first orientation and a second cleaning area associated with the second orientation, the first and second cleaning areas being different from one another.

In one or more embodiment alone or in combination with the aforementioned or aft mentioned embodiments, the cleaning head further includes a third cleaning area at an end of the cleaning head.

In one or more embodiment alone or in combination with the aforementioned or aft mentioned embodiments, the cleaning head has a first cleaning area associated with the first orientation and a second cleaning area associated with the second orientation. The first cleaning area has brush bristles of a first stiffness and the second cleaning area has brush bristles of a second, softer stiffness.

In one or more embodiment alone or in combination with the aforementioned or aft mentioned embodiments, cleaning head has a circular cross section or an ovoid cross section.

In one or more embodiment alone or in combination with the aforementioned or aft mentioned embodiments, the cleaning head is removably secured to the lower region of the handle.

In one or more embodiment alone or in combination with the aforementioned or aft mentioned embodiments, the cleaning head and the lower region comprise complimentary securing members configured to removably secure the cleaning head to the handle.

In one or more embodiment alone or in combination with the aforementioned or aft mentioned embodiments, the cleaning head further comprises a fourth cleaning area that extends towards the handle.

The above-described and other features and advantages of the present disclosure will be appreciated and understood by those skilled in the art from the following detailed description, drawings, and appended claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
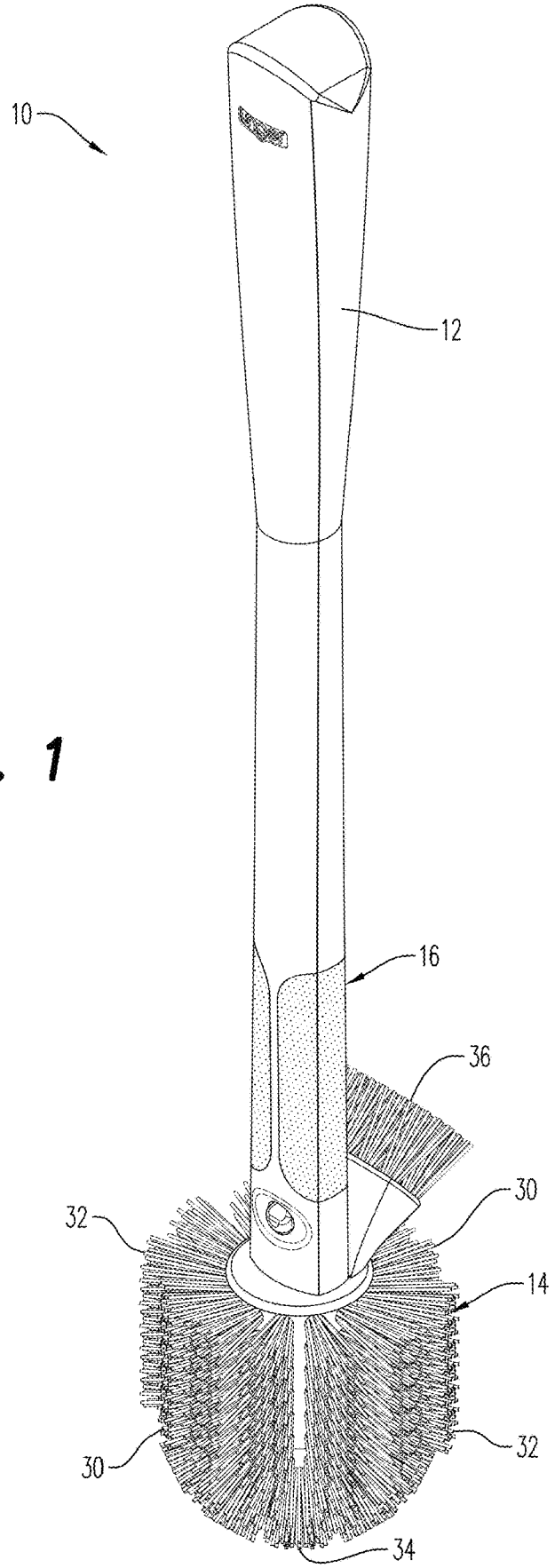
FIG. 1 is a perspective view of an exemplary embodiment of a cleaning device according to the present disclosure.
Figure 2:
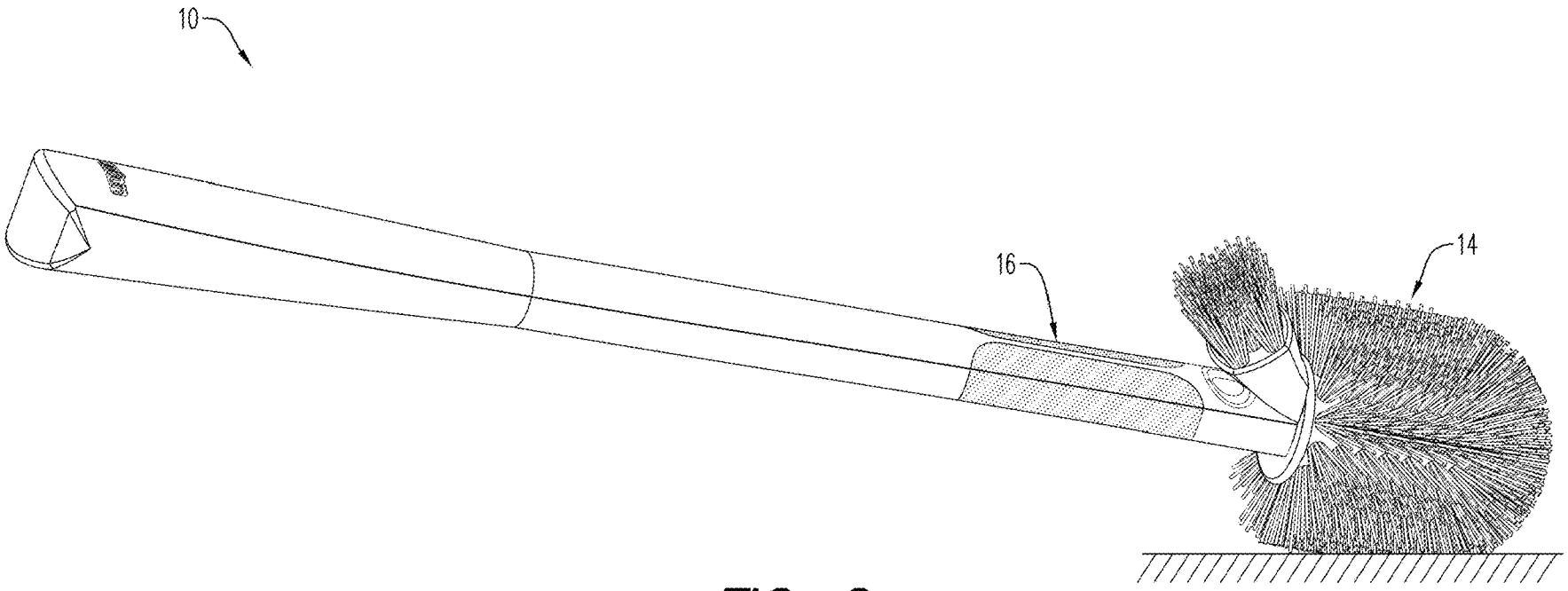
FIG. 2 is a perspective view of the cleaning device of FIG. 1 in a first or inflexible cleaning position or orientation.
Figure 3:
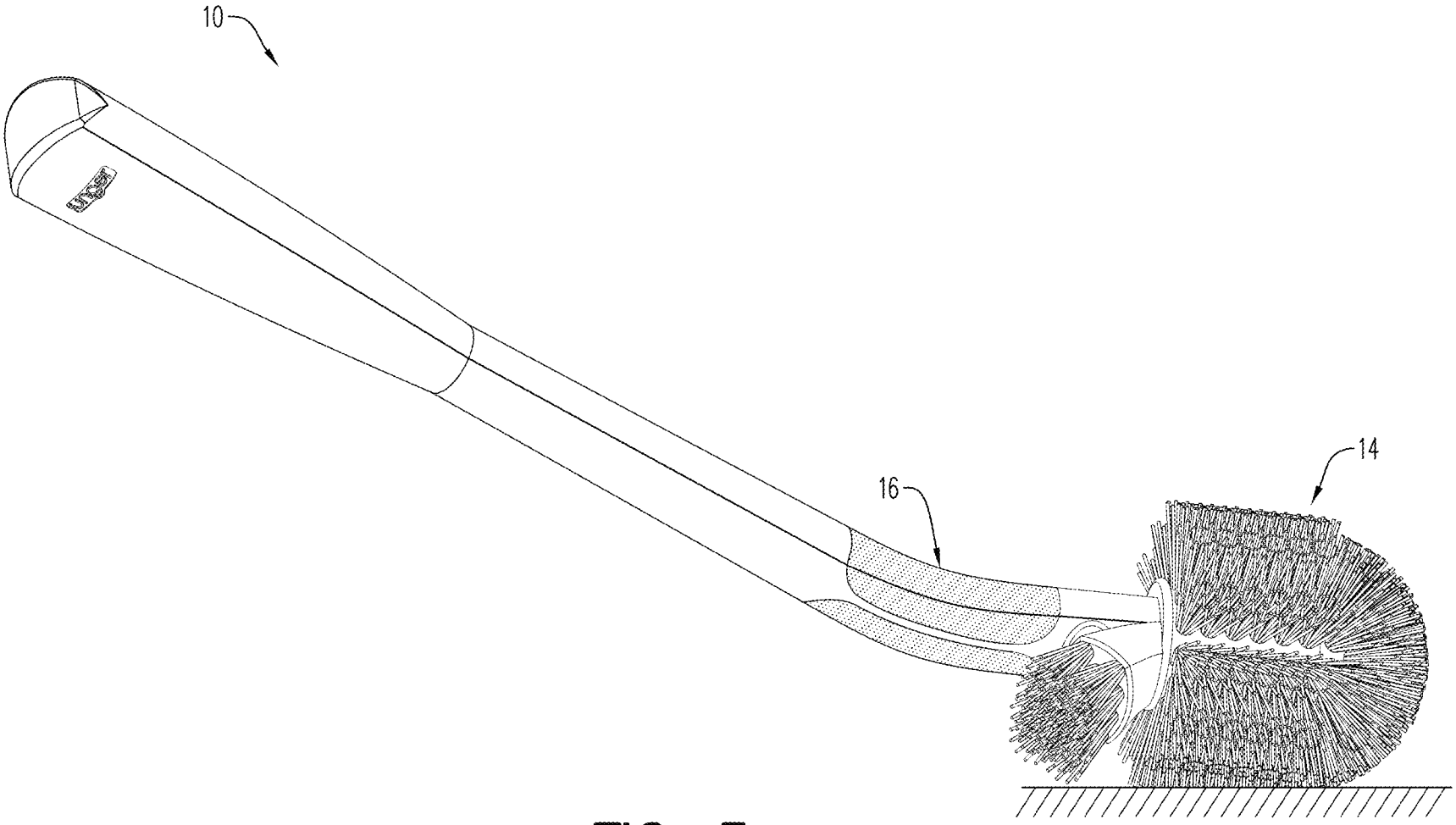
FIG. 3 is a perspective view of the cleaning device of FIG. 1 in a second or flexible cleaning position or orientation.

Referring to the drawings and in particular to FIGS. 1 through 3, an exemplary embodiment of a cleaning device is shown and is generally referred to by reference numeral 10. Cleaning device 10 includes a handle 12 and a cleaning head 14. Advantageously, handle 12 includes a zone 16 that is rigid or inflexible in a first orientation (FIG. 2), but is resiliently flexible in a second orientation (FIG. 3).

Cleaning device 10 is shown by way of example only as a toilet brush. Of course, it is contemplated by the present disclosure for cleaning device 10 to include any type of cleaning device having a handle 12 and a cleaning head 14 such as, but not limited to, dusting devices, wiping devices, brushing devices, mopping devices, and others. For example, cleaning device 10 can be a wiping device for cleaning windows, mirrors, or other surfaces, a brushing device for cleaning surfaces that have difficult to remove debris and/or difficult to reach locations (e.g., toilet trap), a mopping device, a scrubbing device for cleaning tile and/or grout.

A detailed description of cleaning device 10 is made by way of simultaneous reference to FIGS. 1 through 7. As used herein, the term "orientation" shall mean a degree of rotation about a longitudinal axis 18 of handle 14.

Figure 5:
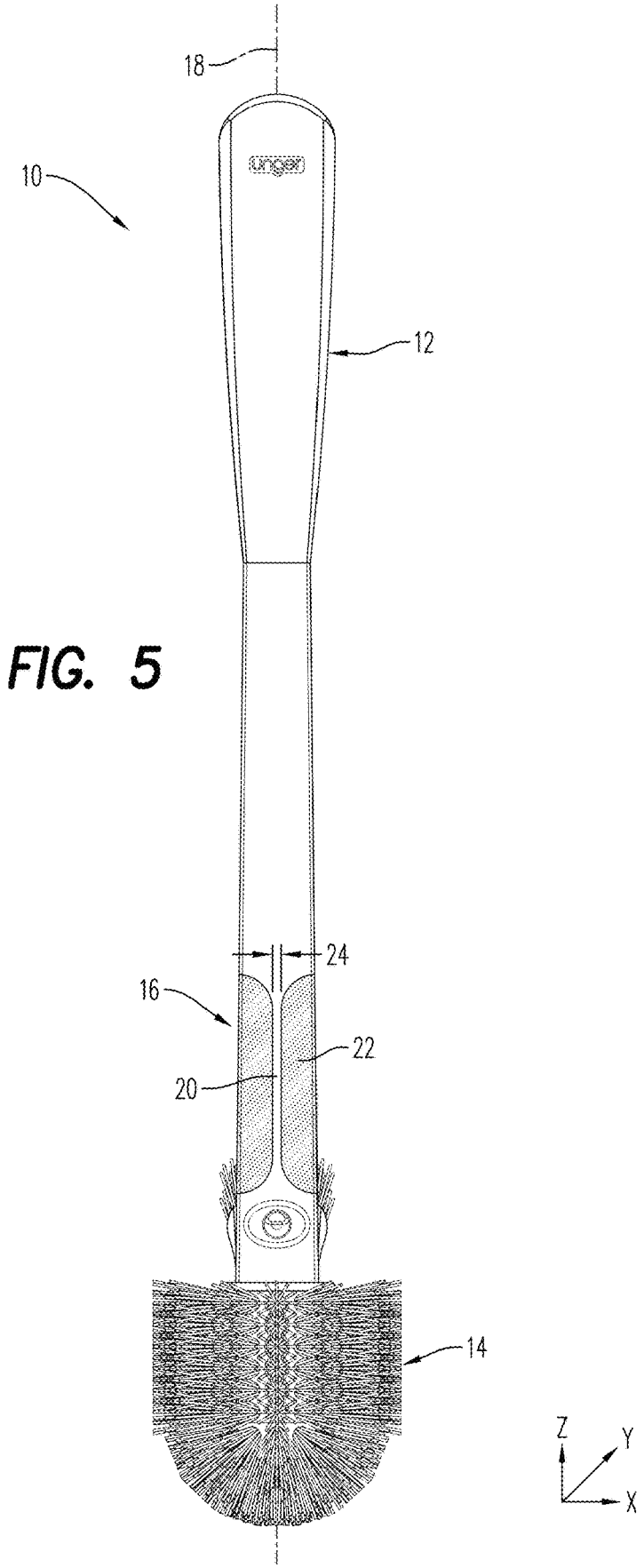
FIG. 5 is a view of the cleaning device of FIG. 1 in a first orientation.
Figure 6:
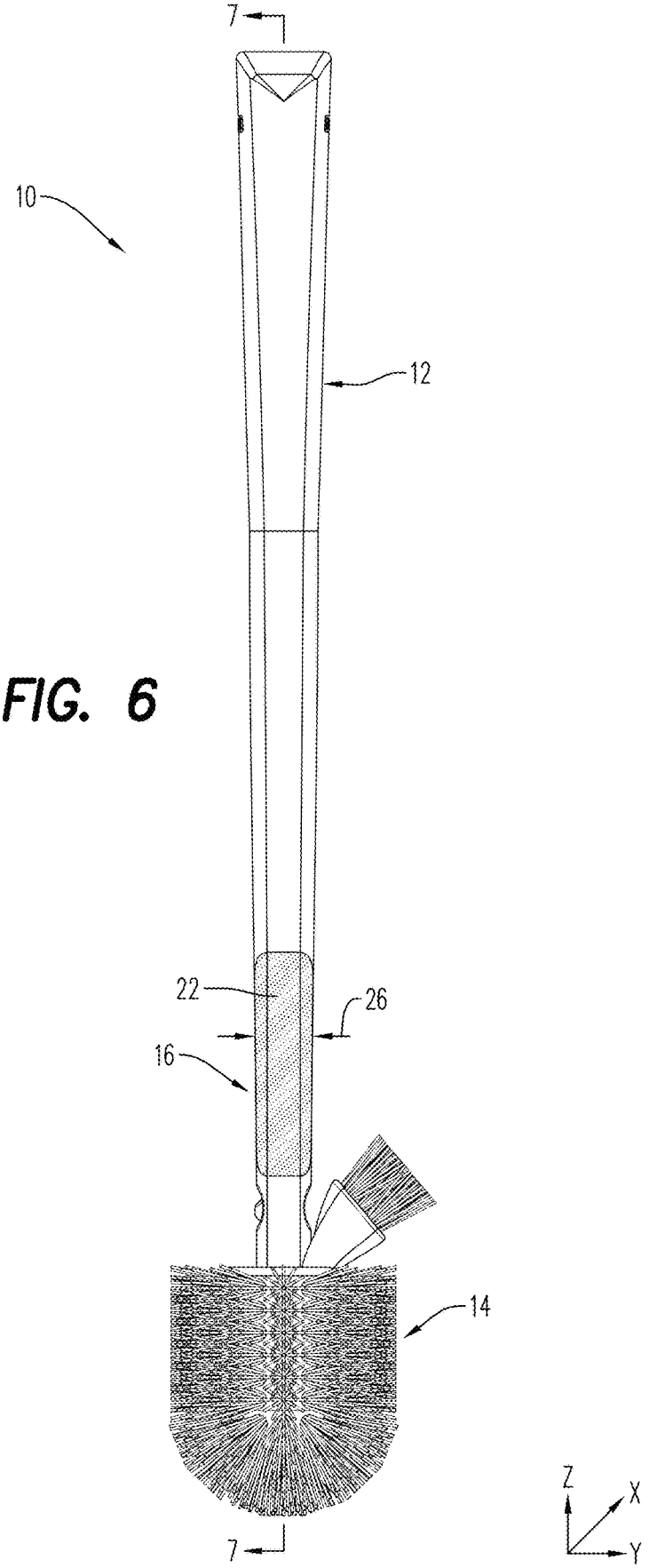
FIG. 6 is a view of the cleaning device of FIG. 1 in a second orientation.
Figure 7:
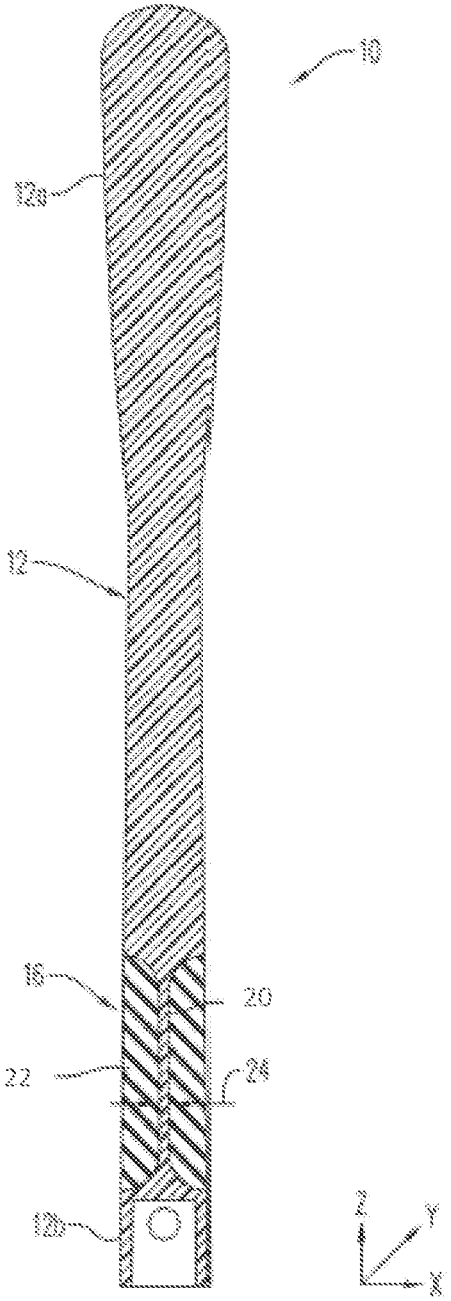
FIG. 7 is a sectional view of the cleaning device of FIG. 1 taken along lines 7-7 of FIG. 6.

For ease of discussion, cleaning device 10 is referred to as having only two orientations, namely the first orientation of FIGS. 2 and 5 and the second orientation of FIGS. 3 and 6. Thus in this embodiment, cleaning device 10 has two of the first orientations—orientations 180 degrees opposed to one another—and two of the second orientations—orientations 180 degrees opposed to one another. Here, cleaning device 10 can be oriented at 0 degrees or 180 degrees to provide the first orientation and can be oriented at 90 degrees or 270 degrees to provide the second orientation.

Stated another way, when longitudinal axis 18 is along the Z-axis, handle 12, due to zone 16, is resiliently flexible when forces are applied along the X-axis but resists flexion when forces are applied along the Y-axis.

Zone 16 includes a structural rib 20 and, in some embodiments, an elastomeric member 22. Structural rib 20 is configured to allow flexion when forces are applied along the X-axis but resist flexion when forces are applied along the Y-axis. Thus, rib 20 has a thickness 24 that runs along the X-axis and a width 26 that runs along the Y-axis. The degree of flexibility of zone 16 can be calibrated or tuned by adjusting the dimensions, shape, and materials of rib 20. For example, the smaller thickness 24 and width 26 are, the more flexible zone 16 will be in the second orientation. Conversely, the larger thickness 24 and width 26 are, the more rigid zone 16 will be will be in the second orientation. Thus, the degree of flexibility of zone 16 can be calibrated or tuned by adjusting one or more of the attributes (e.g., material, thickness, width, length, shape, etc.) of rib 20—including for example the addition of one or more openings or protrusions which can also assist in securing elastomeric member 22 to the rib.

It should also be recognized that one or more of the attributes of rib 20 can be varied along the length to provide the desired flexion. The preferred material for rib 20 is polypropylene. Of course, it is contemplated by the present disclosure for rib 20 to be made of any material providing sufficient rigidity, flexibility, and resiliency to return zone 16 to the normal, un-flexed position after use.

Handle 12 is, preferably molded as a single unitary member with upper handle region 12*a*, lower handle region 12*b*, and rib 20 formed together—with elastomeric member 22 molded over at least portions of the rib.

Elastomeric member 22 is, preferably, over molded onto rib 20 during manufacture using a material such as, but not limited to a thermoplastic elastomer (TPE). Of course, it is contemplated by the present disclosure for elastomeric member 22 to be secured to handle 12 in any desired manner such as, but not limited to, mechanical fastening, thermal fastening, adhesive fastening, and any combinations thereof.

Advantageously, elastomeric member 22 provides, at least in part, elastomeric or resilient properties to zone 16. Accordingly, the degree of flexibility of zone 16 can also be calibrated or tuned by adjusting the dimensions, shape, features, and materials of elastomeric member 22. For example, the harder or higher the durometer of elastomeric member 22, the less flexible zone 16 will be in the second orientation. Conversely, the softer or lower the durometer of elastomeric member 22, the less rigid zone 16 will be will be in the second orientation. In a preferred embodiment, elastomeric member 22 has a durometer of about 40. Again, it should be recognized that one or more of the attributes of elastomeric member 22 can be varied along the length to provide the desired flexion.

Moreover, it is contemplated for elastomeric member 22 to have different material or attributes on one side of rib 20 than on the other side of the rib. In this manner, cleaning device 10 can be configured to have one level of flexibility when bending in one direction and a different level of flexibility when bending in the opposite direction.

The degree of flexibility of zone 16 can also be calibrated or tuned by adjusting the position of the zone along longitudinal axis 18 of handle 12. Additionally, the location of zone 16 along axis 18 can depend upon, at least in part, the cleaning application of device 10—such as near head 14 for toilet bowl cleaning or in the middle of handle 12 to dust under furniture.

In use, cleaning member 10 can be oriented in the first orientation to allow the user to apply differing levels of cleaning pressure to a surface being cleaned. Additionally, cleaning member 10 can be oriented in the second orientation to allow the user to deflect or flex handle 12 so that head 14 can be presented to hard to reach places.

Accordingly, cleaning device 10 is configured to be used in the first orientation when the user requires the ability to apply different levels of cleaning pressure and to be used in the second orientation when the user requires the ability to position cleaning head 14 in hard to reach places.

The terms "rigid", "inflexible", "flexible", and the like are obviously terms of degree and are used herein to describe the general properties of zone 16. Strictly speaking, zone 16 resists flexion in the first orientation but allows flexion, upon application of sufficient force, in the second orientation. Zone 16 can have a stiffness ratio of flexion in the first orientation to flexion the second orientation of between 2:1 to 100:1, more preferably between 5:1 and 50:1, with about 10:1 being most preferred.

In some embodiments, zone 16 can be configured so that cleaning device 10 can apply a maximum cleaning force on the surface being cleaned. For example, it has been found by the present disclosure that configuration of zone 16 that resistance to flexion in the second orientation can be sufficiently low to limit force applied on the surface being cleaned to the maximum cleaning force. Stated another way, zone 16 can be configured so that application of sufficient force along the second orientation results in complete flexion or buckling of the zone, which limits cleaning device 10 to the maximum cleaning force on the surface being cleaned along the second axis.

Figure 4A:
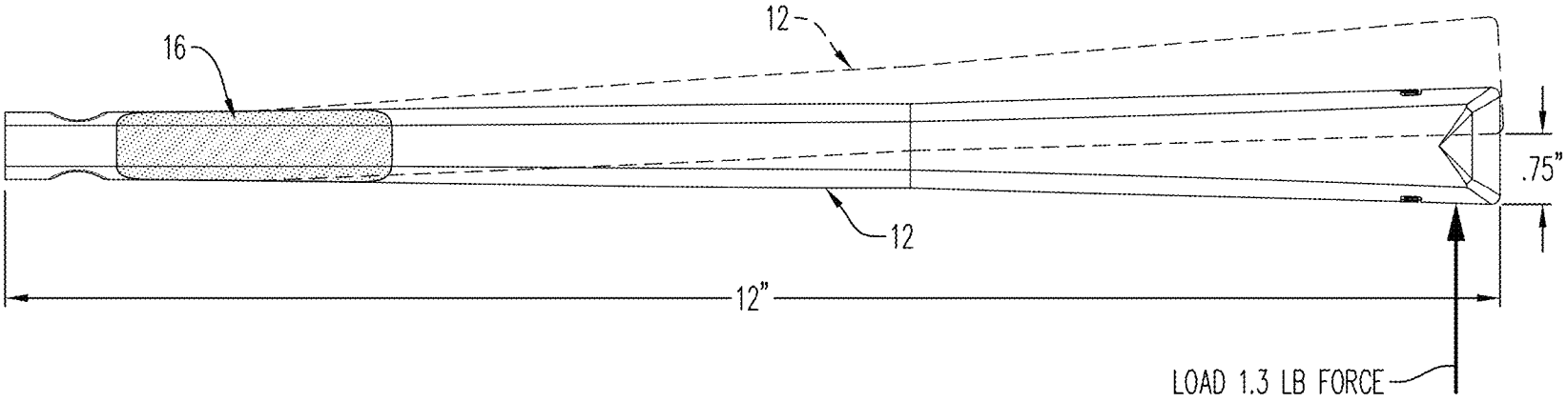
FIGS. 4*a* and 4*b* illustrate exemplary examples of the relative flexibility of the cleaning device of FIG. 1 in the first and second cleaning positions orientations.
Figure 4B:
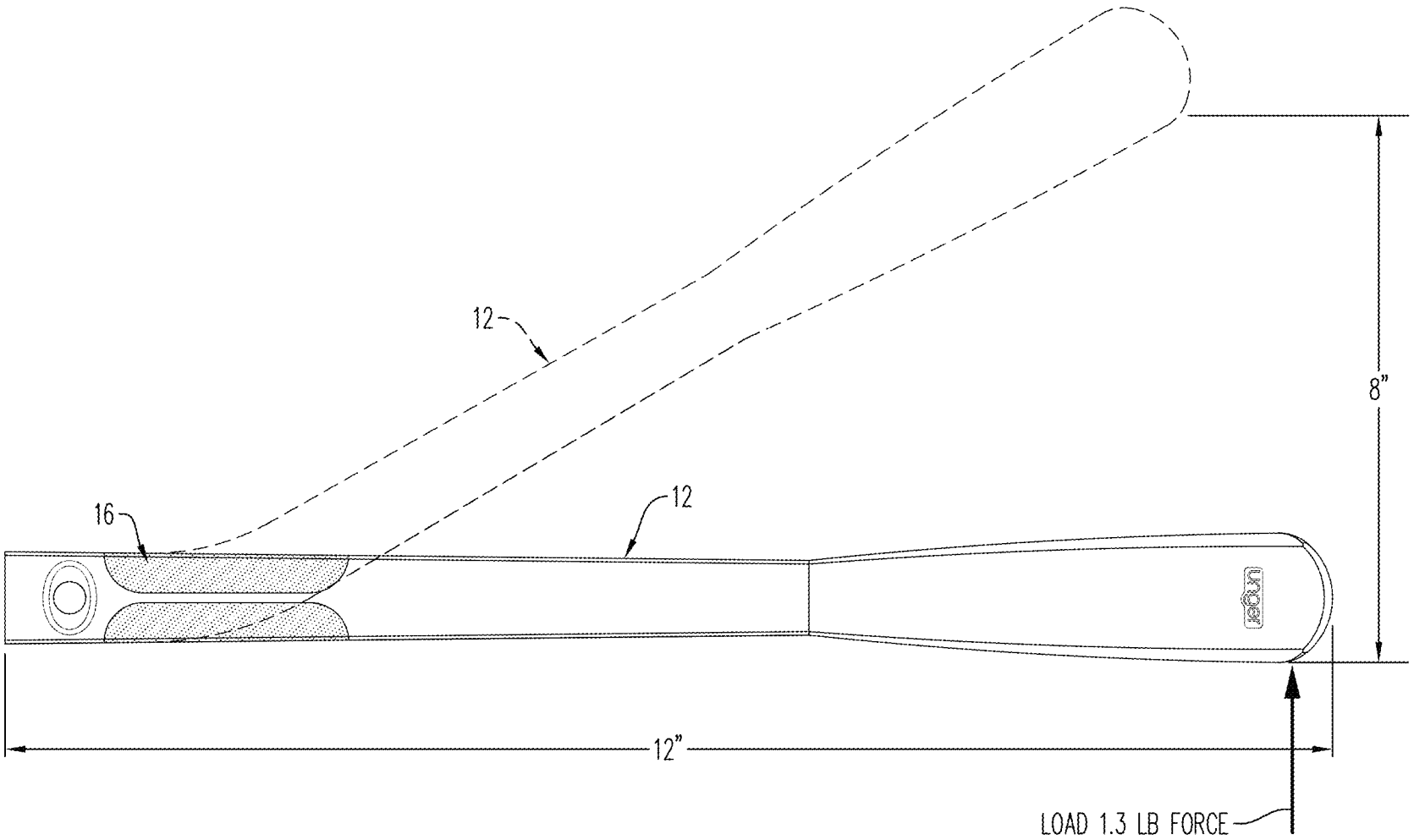

Cleaning device 10 is shown schematically in the first orientation in FIG. 4*a* and in the second orientation in FIG. 4*b* with the application of a force or load of 1.3 pounds in each example. Here, it can be seen that cleaning device 10 flexes or bends about 0.75 inches in the first orientation (i.e., the rigid orientation), but flexes or bends about 8 inches in the second orientation (i.e., the flexible orientation). Stated another way, cleaning device 10 is configured so that it has a ratio of flexion between the first and second orientations of between 10:1 and 2:1, more preferably between 8:1 and 3:1, with about 4:1 being most preferred.

Referring back to FIGS. 1 and 8, head 14 can be configured to have more than one cleaning area that matches or compliments the flexibility and rigidity of zone 16. For example, head 14 can include a first area 30 associated with the first orientation and a second area 32 associated with the second orientation. First area 30 can be provided with stiff brush bristles, while second area 32 can be provided with soft brush bristles.

In this manner, when a user uses cleaning device 10 in the first orientation—where zone 16 is rigid—the stiff brush bristles of the first area 30 are used to clean at differing cleaning pressures. Additionally, when a user uses cleaning device 10 in the second orientation—where zone 16 is resiliently flexible—the soft brush bristles of the second area 32 are used to clean the hard to reach places.

It should be recognized that cleaning device 10 is described above having first area 30 with stiff bristles and second area 32 with soft bristles. Of course, it is contemplated by the present disclosure for first area 30 to have soft bristles and second area 32 to have stiff bristles and any combinations thereof. Moreover, it is contemplated by the present disclosure for first and second areas 30, 32 to have other cleaning materials such as, but not limited to, open-celled foam, closed-celled foam, a scrub pad, a microfiber material, and any combinations thereof.

Thus, cleaning device 10—when configured as a toilet brush—can provide, for example, four different levels of cleaning—with the first orientation having one of the first areas 30 having soft bristles and the other of the first areas 30 having stiff bristles and with the second orientation having one of the second areas 32 having soft bristles and the other of the second areas 32 having stiff bristles.

In some embodiments, head 14 can also include a third area 34 at the end of the head, which can be used by applying a cleaning force along axis 18 (i.e., along the Z-axis). Head 14 can also include a fourth area 36 extending backwards up towards handle 12 for one or more special cleaning purposes.

Figure 8:
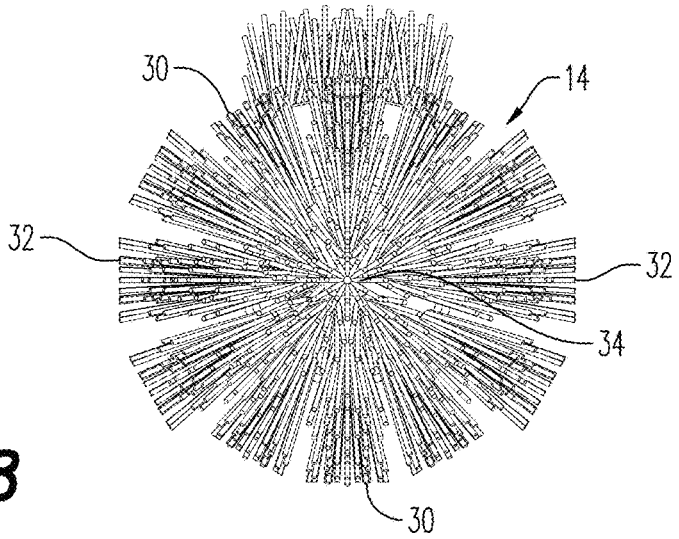
FIGS. 8 through 10 are end views of the cleaning device of FIG. 1 illustrating exemplary embodiments of bristle shapes according to the present disclosure.
Figure 9:
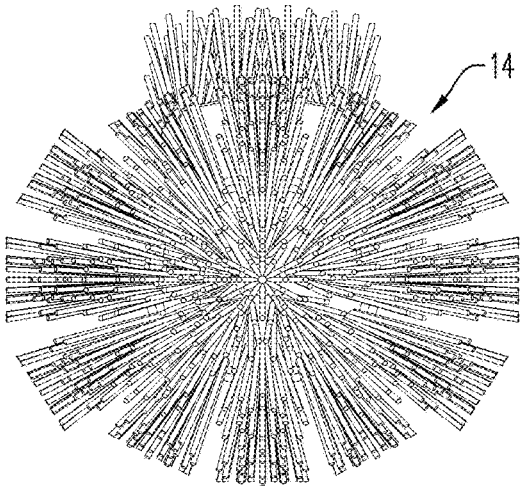
Figure 10:
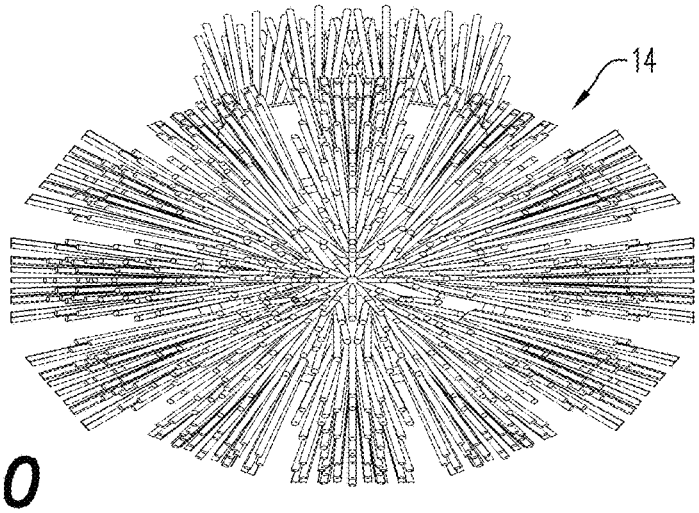

It should be recognized that head 14 is illustrated by way of example only in FIGS. 1 and 8 as having a generally circular cross section. Of course, it is contemplated by the present disclosure for head 14 to have an ovoid cross section of differing degrees as shown in FIGS. 9 and 10, respectively.

Figure 11:
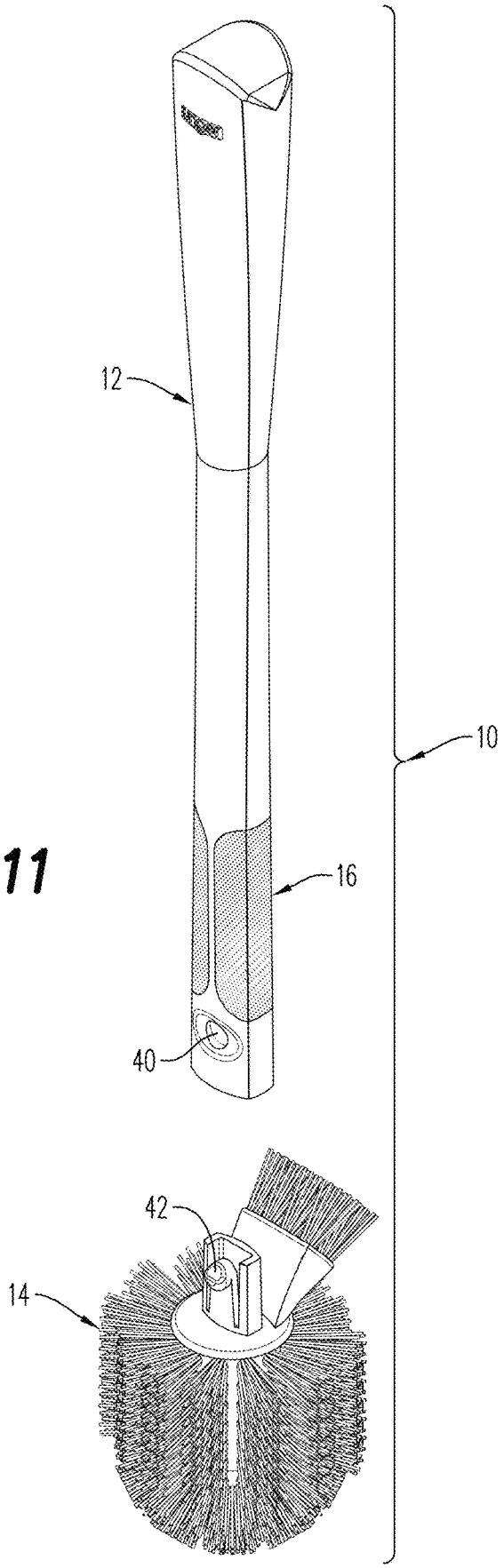
FIG. 11 is a perspective view of the cleaning device of FIG. 1 illustrating an exemplary embodiment of a selectively detachable head.

Turning now to FIG. 11, cleaning device 10 is shown as having head 14 removably connected to handle 12. Here, handle 12 and head 14 include complimentary securing members 40, 42 that allow the user to selectively attach and remove head 14 from handle 12. Here, members 40, 42 are shown as an opening and a deflectable protrusion. Of course, it is contemplated by the present disclosure for cleaning device 10 to find use with any type of complementary securing members.

Figure 12:
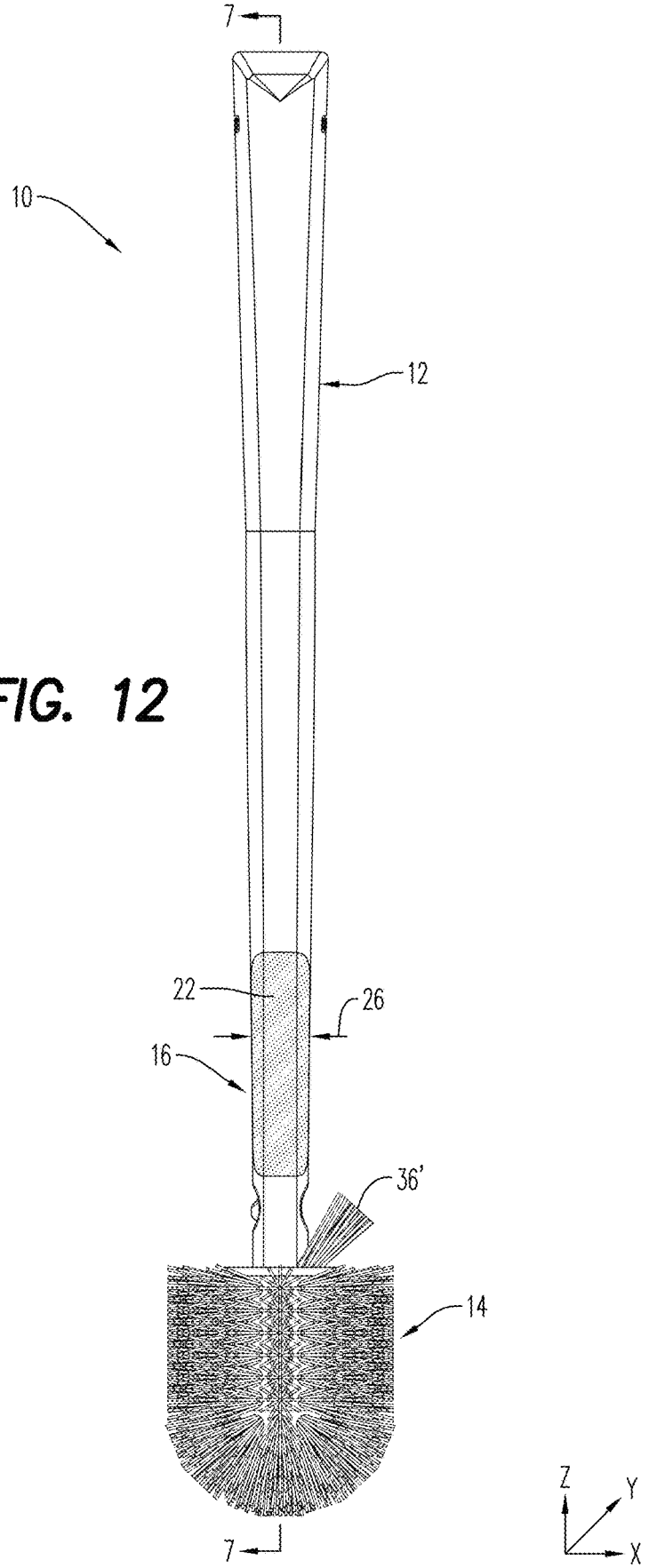
FIG. 12 is a side view of another exemplary embodiment of a bristle pattern according to the present disclosure.

Turning now to FIG. 12, an alternate exemplary embodiment of head 14 is shown. Here, fourth area 36' extends backwards up towards handle 12 for one or more special cleaning purposes but is formed using at least some of the bristles of head 14 that have a length that differs from the remaining bristles—either in certain locations around the circumference or around the entire circumference—so as to increase the functionality and clean in hard to reach places.

Figure 13:
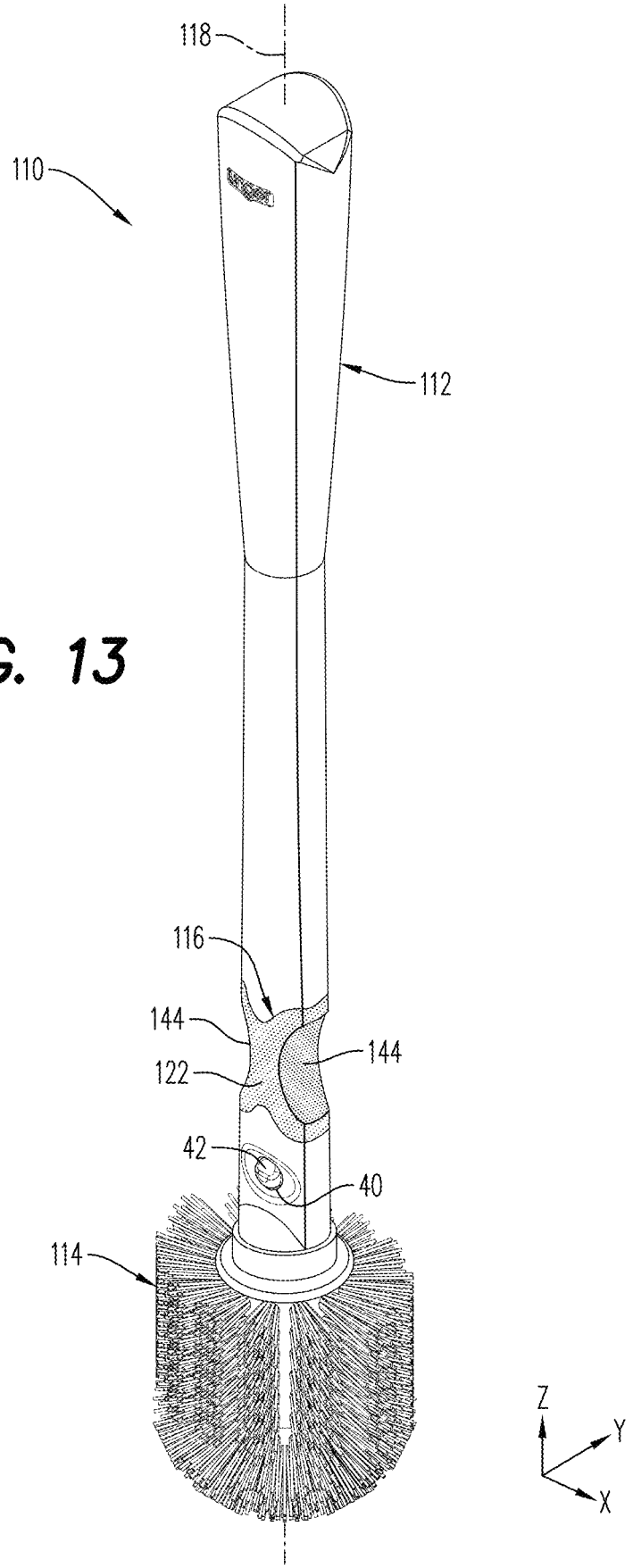
FIG. 13 is a perspective view of an alternate exemplary embodiment of a cleaning device according to the present disclosure.

Referring now to FIG. 13, an alternate exemplary embodiment of a cleaning device according to the present disclosure is shown and is generally referred to by reference numeral 110. Here, component parts performing similar and/or analogous functions are labeled in multiples of 100.

Cleaning device 110 includes a handle 112 and a cleaning head 114 having zone 116 that is rigid or inflexible in a first orientation, but is resiliently flexible in a second orientation. Stated another way, when longitudinal axis 118 is along the Z-axis, handle 112, due to zone 116, is resiliently flexible when forces are applied along the X-axis but resists flexion when forces are applied along the Y-axis.

In this embodiment, zone 116 includes a structural rib that is encased or covered by an elastomeric member 122. The structural rib is configured, as discussed above with respect to cleaning device 10, to allow flexion when forces are applied along the X-axis but resist flexion when forces are applied along the Y-axis. Elastomeric member 122 is, preferably, over molded onto the rib during manufacture using a material such as, but not limited to a thermoplastic elastomer (TPE). Of course, it is contemplated by the present disclosure for elastomeric member 122 to be secured to handle 112 in any desired manner such as, but not limited to, mechanical fastening, thermal fastening, adhesive fastening, and any combinations thereof.

Elastomeric member 122 provides, at least in part, elastomeric or resilient properties to zone 116. In the illustrated embodiment, elastomeric member 122 includes recesses 144 that—together with one or more attributes of the rib and/or of the elastomeric member—provide the desired degree of flexibility to zone 116.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cleaning device comprising:

a cleaning head;

a handle made from a polymer material, the handle having a first portion, a second portion, and a deflection zone therebetween, the deflection zone is rigid or inflexible in a first orientation when forces are applied in a first direction and resiliently flexible in a second orientation when forces are applied in a second direction, perpendicular to the first direction, the deflection zone having a rib integrally formed between the first portion and the second portion; and a member coupled to at least a first side of the rib, the member being made from an elastomeric material.

2. The cleaning device of claim 1, wherein the member is coupled to at least the first side and an opposing second side of the rib.

3. The cleaning device of claim 2, wherein the member completely encapsulates the rib.

4. The cleaning device of claim 2, wherein the member comprises a first portion on the first side of the rib and a second portion on the second side of the rib, the first portion and second portion being made from different elastomeric materials.

5. The cleaning device of claim 1, wherein the rib includes one or more openings or protrusions, the member being coupled to the one or more openings or protrusions.

6. The cleaning device of claim 1, wherein the handle is formed as a single unitary structure and the member is over-molded on to the rib.

7. The cleaning device of claim 6, wherein the elastomeric material is a thermoplastic elastomer.

8. The cleaning device of claim 1, wherein the member has a durometer of about 40.

9. The cleaning device of claim 1, wherein the cleaning head has a circular cross-section.

10. The cleaning device of claim 1, wherein the cleaning head has an ovoid cross section.

11. The cleaning device of claim 1, wherein the member includes a recess on a side opposite the rib.

12. The cleaning device of claim 1, wherein the rigidity or inflexibility of the deflection zone is defined by a stiffness ratio, the stiffness ratio is a first orientation flexion to a second orientation flexion, wherein the stiffness ratio is at least 2:1.

13. The cleaning device of claim 1, wherein the cleaning head is removably connected to the handle.

14. A cleaning device comprising:

a cleaning head;

a handle made from a polymer material, the handle comprising a first portion having a first connection, a second portion having a second connection, and a deflection zone therebetween, wherein the deflection zone is resiliently flexible when forces are applied in a first direction and resists flexion when forces are applied in a second direction, perpendicular to the first direction, wherein the deflection zone includes a rib, the rib comprising a first end that connects to the first connection and a second end that connects to the second connection;

a first member coupled to a first side of the rib; and a second member coupled to a second side of the rib opposite the first side, wherein the first member and the second member are made from an elastomeric material, wherein a width of the rib at the first end is equal to a width of the first portion at the first connection and a width of the rib at the second end is equal to a width of the second portion at the second connection.

15. The cleaning device of claim 14, wherein a width of the first member and a width of the second member is equal to a width of the rib along the deflection zone.

16. The cleaning device of claim 14, wherein the first member and the second member are made from different elastomeric materials.

17. The cleaning device of claim 14, wherein the rib includes one or more openings or protrusions, wherein the first member and the second member are coupled to the one or more openings or protrusions.

18. A cleaning device comprising:

a cleaning head having a first cleaning area associated with the first axis and a second cleaning area associated with the second axis, the first cleaning area having brush bristles of a first length, and the second cleaning area having brush bristles of a second, different length;

a handle made from a polymer material, the handle having a first portion, a second portion, and a deflection zone therebetween, the deflection zone being resiliently flexible when forces are applied along a first axis but resists flexion when forces are applied along a different, perpendicular axis, the deflection zone having a rib integrally formed between the first portion and the second portion; and a member coupled to at least a first side of the rib, the member being made from an elastomeric material.

19. The cleaning device of claim 18, wherein the cleaning head is removably connected to the handle.

20. A cleaning device comprising:

a cleaning head;

a handle made from a polymer material, the handle comprising a first portion having a first connection, a second portion having a second connection, and a deflection zone therebetween, wherein the deflection zone is resiliently flexible when forces are applied in a first direction and resists flexion when forces are applied in a second direction, perpendicular to the first direction, wherein the deflection zone includes a rib, the rib comprising a first end that connects to the first connection and a second end that connects to the second connection;

a first member coupled to a first side of the rib; and a second member coupled to a second side of the rib opposite the first side, wherein the first member and the second member are made from an elastomeric material, wherein a width of the first member and a width of the second member is equal to a width of the rib along the deflection zone.

* * * * *